US005242110A

United States Patent [19]

Riley

[11] Patent Number: 5,242,110

[45] Date of Patent: Sep. 7, 1993

[54] METHOD FOR CHANGING THE DIRECTION OF AN ATOMIZED FLOW

[75] Inventor: Michael F. Riley, Danbury, Conn.

[73] Assignee: Praxair Technology, Inc., Danbury, Conn.

[21] Appl. No.: 801,518

[22] Filed: Dec. 2, 1991

[51] Int. Cl.[5] ..... B05B 17/04; B05B 1/26

[52] U.S. Cl. ..... 239/11; 239/297; 239/589.1

[58] Field of Search ..... 239/11, 297, 589.1, 239/296

[56] References Cited

U.S. PATENT DOCUMENTS

| | | | |
|---|---|---|---|
| 3,253,783 | 5/1966 | Probst et al. | 239/82 |
| 3,340,334 | 9/1967 | Feldman et al. | 264/12 |
| 3,692,443 | 9/1972 | Lightner | 425/7 |
| 3,813,196 | 5/1974 | Backstrom et al. | 425/7 |
| 3,826,598 | 7/1974 | Kaufman | 425/7 |
| 3,876,362 | 4/1975 | Hirose | 431/9 |
| 4,064,295 | 12/1977 | Singer | 239/11 X |
| 4,585,177 | 4/1986 | Sugawara et al. | 239/590 |
| 4,631,013 | 12/1986 | Miller | 425/7 |
| 4,681,258 | 7/1987 | Jenkins et al. | 239/297 X |
| 4,778,516 | 10/1988 | Raman | 75/0.5 C |
| 4,905,899 | 3/1990 | Coombs et al. | 239/11 |
| 4,988,464 | 1/1991 | Riley | 264/12 |

FOREIGN PATENT DOCUMENTS

| | | | |
|---|---|---|---|
| 225080 | 6/1987 | European Pat. Off. . | |
| 1060237 | 12/1983 | U.S.S.R. | 239/297 |
| 501392 | 2/1939 | United Kingdom | 239/296 |
| 1379261 | 1/1975 | United Kingdom . | |
| 9112088 | 8/1991 | World Int. Prop. O. | 239/297 |

OTHER PUBLICATIONS

Unal, Material Science Technology, vol. 3, pp. 1029–1039, Dec. 1987.

Gretzinger and Marshal, Aiche Journal, vol. 7, No. 2, pp. 312–318, Jun. 1961.

*Primary Examiner*—Andres Kashnikow
*Assistant Examiner*—William Grant
*Attorney, Agent, or Firm*—Stanley Ktorides

[57] ABSTRACT

A method and apparatus for changing the direction of a flow of atomized material over a wide field without mechanical oscillation wherein annular atomization is carried out with a pressure gradient effected by application of one or more fluidic control gas jets.

14 Claims, 3 Drawing Sheets

METHOD FOR CHANGING THE DIRECTION OF AN ATOMIZED FLOW

TECHNICAL FIELD

This invention relates generally to spraying of atomized material and more particularly to changing the flow direction of the atomized spray.

BACKGROUND ART

Atomized spraying of, for example, metals or ceramics is employed to apply coatings on to substrates and also to produce parts of various shapes which would otherwise require production by casting. In combustion, atomized spraying is employed for fuel flow. One recent significant advancement in this field is the gas atomization method disclosed and claimed in U.S. Pat. No. 4,988,464 to M. F. Riley.

It is desirable in carrying out coating or casting using spray deposition to change the direction of the atomized flow in order to deposit the atomized spray over a wide area. For coating or casting of thin shapes, it is critical that the spray deposit be very uniform over the wide area of the spray. For these thin shapes, it is also desirable to change the direction of the atomized flow several times per second so that an economical weight of material can be cast per hour. Heretofore such directional changes have been accomplished mechanically by moving or oscillating the entire spray deposition apparatus or moving or oscillating at least the nozzle from which the atomized spray is injected toward the substrate or mold. This method is mechanically difficult and cumbersome. Moreover the field of view over which the atomized spray may be directed is limited.

Accordingly it is an object of this invention to provide a system for atomized spraying wherein the flow direction of the atomized spray may be changed without need for mechanical movement of any part of the system.

It is another object of this invention to provide a system for atomized spraying wherein the flow direction of the atomized spray may be changed over a wide field of view.

It is a further object of this invention to provide a system for atomized spraying wherein the flow direction of the atomized spray may be Changed several times per second.

It is yet another object of this invention to provide a system for atomized spraying wherein a wide, uniform, thin layer of atomized material may be deposited on a substrate or mold.

SUMMARY OF THE INVENTION

The above and other objects which will become apparent to one skilled in the art upon a reading of this disclosure are attained by the present invention one aspect of which is:

A method for changing the direction of an atomized flow comprising:

(A) passing atomizable material through an atomizing conduit having a section of constant cross-sectional area and downstream thereof a section of increasing cross-sectional area;

(B) atomizing said atomizable material by applying an atomizing gas flow thereto in an annular orientation to said atomizable material to produce an atomized flow;

(C) contacting the atomizing gas flow with fluidic control gas to create a pressure differential across the atomizing gas flow; and (D) causing the flow direction of the atomized flow to change by application of said pressure differential to the atomized flow as a consequence of the atomization of said atomizable material by the application of the atomizing gas flow thereto.

Another aspect of the invention is:

An atomizing nozzle for changing the direction of an atomized flow comprising:

(A) an atomizing conduit having a section of constant cross-sectional area and a section of increasing cross-sectional area;

(B) an annulus for providing atomizing gas to atomizable material within the atomizing conduit; and (C) at least one fluidic control gas port for directing fluidic control gas into the atomizing conduit.

DETAILED DESCRIPTION

The invention will be described in detail with reference to the drawings.

Figure 1:
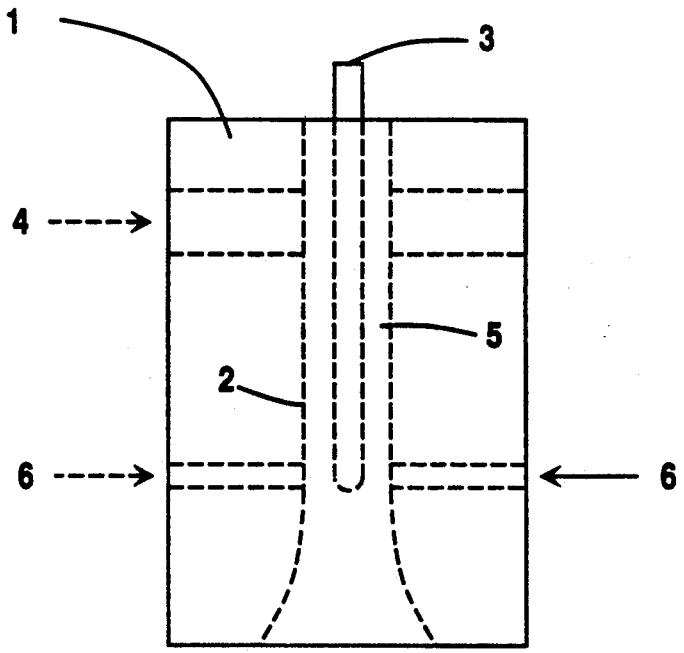
FIG. 1 is a simplified cross-sectional representation of one embodiment of the fluidic atomization system of this invention useful for spray deposition.

Referring now to FIG. 1, atomizing nozzle 1 comprises an atomizing conduit 2 which has a section of constant cross-sectional area and, downstream thereof, a section of increasing cross-sectional area. Atomizable material is introduced into and is passed through the atomizing conduit. The atomizable material may be liquid or powder. Among metals which may be employed with this invention one can name iron, steel, copper, copper alloys, nickel, nickel alloys, cobalt, cobalt alloys, aluminum, aluminum alloys and the like. Among ceramic materials which may be employed with this invention one can name zirconia, zirconia-based ceramics, alumina, alumina-based ceramics, silicates, tungsten carbide, silicon carbide, molybdenum disilicide and the like. Among fuels which may be employed with this invention one can name heating oil, diesel fuel, jet fuel, coal-oil and coal-water slurries and the like.

In the embodiment illustrated in FIG. 1 the atomizable material is provided through a portion of the atomizing conduit within pouring tube 3. When a pouring tube is employed in the practice of this invention the atomizable material will flow out from the pouring tube while still within the atomizing conduit. This outflow from the pouring tube may occur within the section of constant cross-sectional area, or within the section of increasing cross-sectional area, or at the transition point.

In the embodiment illustrated in FIG. 1, the atomizable material passes out of the pouring tube within the area of increasing cross-sectional area just downstream of the transition point.

Atomizing gas is applied in an annular orientation to the atomizable material to produce an atomized flow. In the embodiment illustrated in FIG. 1, atomizing gas is provided into atomizing conduit 2 through gas inlets 4. The atomizing gas flows through atomizing conduit 2 through annulus or coaxial passage 5 formed by pouring tube 3 and the wall of atomizing conduit 2. Thereafter the atomizing gas contacts the atomizable material in an annular orientation to produce an atomized flow. The atomizing gas may be any effective gas such as nitrogen, argon, helium, oxygen, air and the like. Preferably the atomizing gas is an inert gas such as nitrogen or argon. When inert gas is employed the gas may include a small amount of oxygen to inhibit the reaction of explosive metal powders such as magnesium or aluminum. As used herein the term "gas" contemplates gas mixtures as well as pure gas.

Fluidic control gas is introduced into the atomizing conduit. The fluidic control gas may be any gas or mixture which may be used as the atomizing gas and may be the same or a different gas or gas mixture as the particular atomizing gas being used in any particular practice of the invention. Preferably the fluidic control gas is introduced into the atomizing conduit in a direction substantially perpendicular to the axial center line of the atomizing conduit, although the fluidic control gas may be introduced at any effective angle. Generally the angle will be within the range of from plus or minus 15 degrees from the perpendicular to the axial centerline of the atomizing conduit. The fluidic control gas may be introduced into the atomizing conduit within the section of constant cross-sectional area, or within the section of increasing cross-sectional area, or at the transition point. Preferably, such as in the embodiment illustrated in FIG. 1, the fluidic control gas passes into the atomizing conduit through one of a plurality of fluidic control gas ports 6 at the end of the section of constant cross-sectional area immediately upstream of the transition point.

The increasing cross-sectional area section of the atomizing conduit may be at a constant angle, i.e. conical, or at an increasing angle, i.e. curved, and may have an angle at the exit or output of the atomizing conduit of up to 50 degrees from the axial centerline of the atomizing conduit. The conical angle or radius of curvature may increase along the length of the increasing cross-section area. In the embodiment illustrated in FIG. 1 there is shown a conical section having an initial angle of 15 degrees from the axial centerline which increases to an angle of 30 degrees from the axial centerline.

The atomizing nozzle of the invention may contain any effective number of fluidic control gas ports. Generally the atomizing nozzle will contain from 1 to 6 fluidic control gas ports. The fluidic control gas will generally be introduced into the atomizing conduit through one fluidic control gas port at one time, although fluidic control gas may be employed which is injected from more than one port at the same time.

When the atomizing gas passes into the section of increasing cross-sectional area, it entrains the surrounding gas, causing the surrounding gas to move with it by viscous drag. Because of the confining walls in the section of increasing cross-sectional area, this entrainment causes a reduction in the absolute pressure surrounding the atomizing gas flow. So long as the entrainment is uniform, the pressure surrounding the atomizing gas flow is uniform and the atomizing gas flow moves along the axial centerline. When, within the atomizing conduit, the fluidic control gas preferentially contacts one side of the atomizing gas flow, the fluidic control gas partially replaces the entrained gas on that side. As a result, the pressure on that side of the atomizing gas flow is reduced less than on other sides. Thus, a pressure differential or gradient is created across the atomizing gas flow. The magnitude of the pressure differential is affected by the fluidic control gas pressure and by the distance between the atomizing gas flow and the wall of the section of increasing cross-sectional area. At first, the pressure differential causes a slight deflection of the atomizing gas away from the fluidic control gas flow and toward the opposite wall in the section of increasing cross-sectional area. This further confines the flow on the side of the atomizing gas opposite the fluidic control gas, further lowering the pressure on that opposite side and accentuating the pressure differential. This leads to continual deflection of the jet until the atomizing gas flows along the opposite wall.

The atomizing gas atomizes the atomizable material and, with the pressure differential, causes the flow of atomized material to change direction as a consequence of this pressure differential or gradient away from the direction of higher pressure and toward the direction of lower pressure.

The magnitude of the deflection of the atomizing gas flow is far greater than would be the result of a simple vector sum of the momentum of the atomizing gas flow and the momentum of the fluidic control gas flow. This has important consequences for an atomization spraying process since the deflection can be achieved with relatively little fluidic control gas flow. First, the volume, and thereby the cost, of the fluidic control gas is minimized. Second, the total gas flow is nearly constant regardless of whether the atomizing gas is directed along the axial centerline, without fluidic control gas flow, or to one side, with fluidic control gas flow. Thus, the total gas momentum and the heating or cooling effect of the atomizing gas on the atomized material is nearly constant, regardless of the direction in which the atomized flow is directed.

The flow direction of atomized matter can be further changed by shutting off the flow of fluidic control gas from the first port and injecting fluidic control gas from a second port to apply a pressure differential across the atomizing gas flow in a second direction. Any effective number of directional changes can thus be made by employing the appropriate number of fluidic control gas ports. The timing of the spraying in any given direction and the frequency of the switching can be varied to produce the desired shape of a deposit. Moreover, further directional changes can be made by employing fluidic control gas injected from two or more ports simultaneously to produce an intermediate deflection direction. When the flow of fluidic control gas from all ports is terminated, the atomized matter will flow in a straight line, i.e. in line with the axial centerline of the atomizing conduit. The flow of fluidic control gas to the various ports, as well as the flow of atomizing gas, is controlled by appropriate conventional valving which is not illustrated in the drawings but is familiar to one skilled in the art of fluid flow control.

The atomized matter may be applied, for example, as a coating on a substrate or may be applied to a shaped substrate or mold to produce a shaped object when the atomizing nozzle of this invention is employed in a spray deposition device. When the atomized matter is combustible, it may be combusted when the atomizing nozzle is employed in a burner or combustion device.

It is important for the attainment of the beneficial results of deflection or directional change over a wide angle field of view that the application of the fluidic control gas be combined with the application of the atomizing gas to the atomizable material in an annular orientation. The following examples and comparative examples are presented to illustrate this point. The examples are presented for illustrative purposes and are not intended to be limiting.

Figure 3:
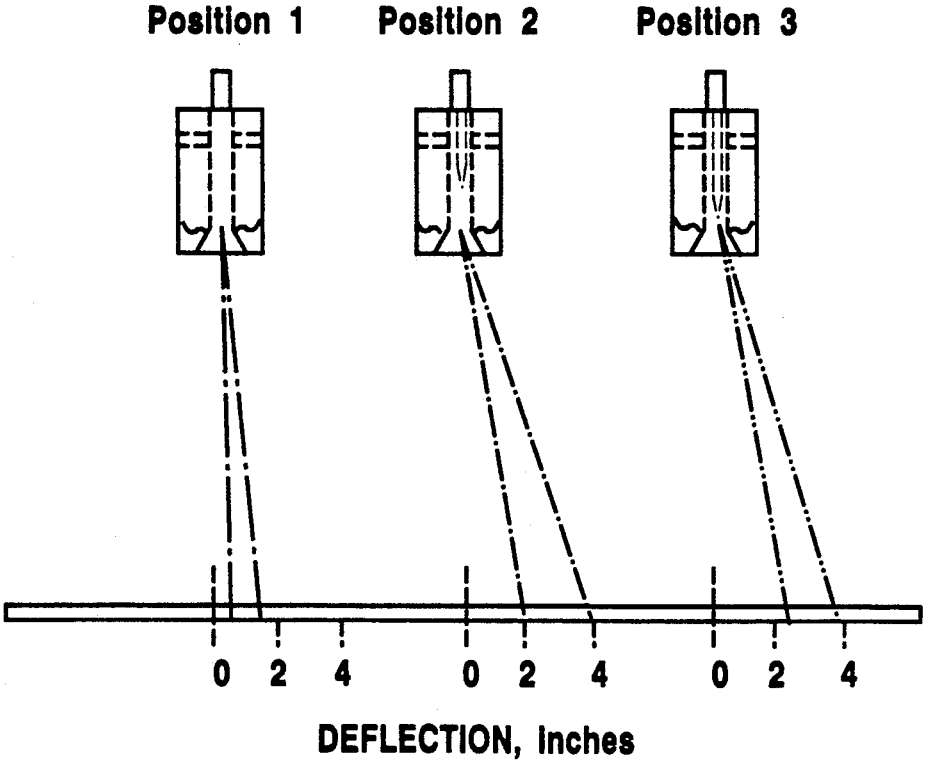
FIG. 3 is a pictorial representation of test results obtained with the system of this invention and comparative test results when the invention was not employed.

Employing an atomizing nozzle similar to that illustrated in FIG. 1 a series of tests were carried out using water as the atomizable material, nitrogen as the atomizing gas and nitrogen as the fluidic control gas. The nozzle was cylindrical having a diameter of three inches and a length of 1.5 inches. The atomizing conduit had a diameter of 0.75 inch in the section of constant diameter and diverged at an angle of 15 degrees for a distance of 0.75 inches and then at an angle of 30 degrees in a conical section of increasing diameter to a final diameter of 1.5 inches. Five different pouring tubes were used each having a different diameter. The diameters were 0.125, 0.25, 0.375, 0.5 and 0.625 inch. Thus the ratio of the diameter of the pouring tube to the diameter of the atomizing conduit, or d/D ranged from 0.167 to 0.833. The pouring tube was positioned so that its output end was at three different positions which are illustrated in FIG. 3. Position 1 was at the input end of the atomizing conduit, position 2 was at about the middle of the atomizing conduit, and position 3 was within the conical section just past the transition point. As can be seen, with the pouring tube in position 1 the atomizing gas was not applied to the atomizable material in an annular orientation but rather in a direct contact orientation, while with the pouring tube in either position 2 or position 3 the atomizing gas was applied to the atomizable material in an annular orientation.

Figure 2:
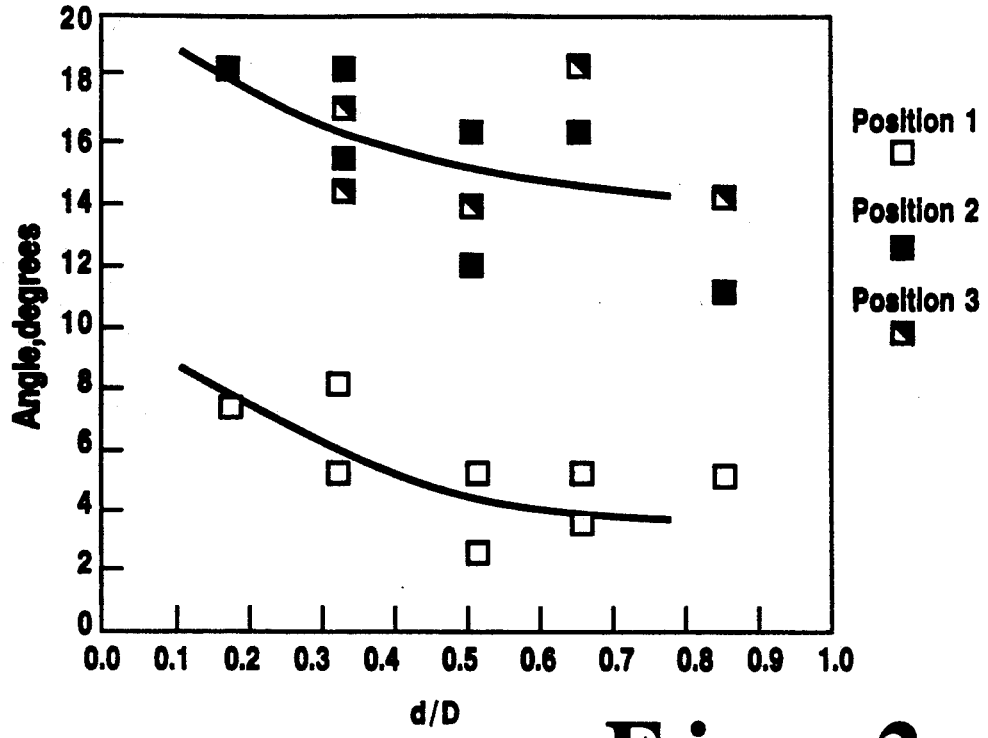
FIG. 2 is a graphical representation of test results obtained with the system of this invention and comparative test results when the invention was not employed.

A series of tests were run for different d/D ratios with the pouring tube in each of the three positions while holding all other parameters constant, and the results are shown in FIGS. 2 and 3. FIG. 2 illustrates the deflection angle of the centerline of the spray and FIG. 3 illustrates the actual range of deflections of the centerline of the spray in inches as experienced on a receiver located twelve inches from the output end of the atomizing nozzle.

As is clearly demonstrated by these examples and comparative examples, one is able to attain a deflection field which is wider by a factor of about 2 when the invention is employed over that attainable when the invention is not employed. While not wishing to be held to any theory, applicant believes that the advantageous results achieved by the invention, which combines annular atomization with fluidic control, over the results observed when only fluidic control is employed may be explained, at least in part, by the substantial entrainment of the atomizable material into the atomizing gas in the annular configuration. Without this substantial entrainment, the atomizable material and atomizing gas move independently, i.e. there is some slippage between the two flows. The pressure differential established by the fluidic control gas is then effective only in deflecting the atomizing gas, while the flow of the atomizable material undergoes little deflection. The pressure differential is significantly more effective in deflecting the flow of atomizable material when the fluidic control gas is applied to atomizable material highly entrained in atomizing gas which is in an annular or coaxial orientation to the flow of the atomizable material. It is recognized that the annular or coaxial orientation of the flows of the atomizing gas and the atomizable material need not be completely around the flow of atomizable material for the invention to work effectively although a complete or total annular or coaxial orientation is preferred.

To provide useful deposition rates for thin deposits, such as strip, it is important to be able to change the direction of the flow of atomizable material several times per second. This requires appropriate valve and valve actuating mechanisms. To cycle the flow direction back and forth between two directions at 10 hertz (cycles per second), rapid response valves, such as those having a double solenoid actuated spool-and-sleeve design, are required. To control the solenoids a well-timed, rapid response electrical signal is needed, such as is produced by a programmable controller using rapid response, transistor outputs. As mentioned above, the amount of time the spray is deflected in a given direction can be varied to control the shape of the deposit. It was also noted above that the magnitude of the pressure differential which creates the deflection is dependent on the fluidic control gas pressure. Applicant has found that at high switching frequencies, a deposit of uniform thickness is formed only when the fraction of time spent spraying in a given direction is selected in concert with the fluidic control gas pressure and that to produce a uniform deposit, especially for thin sections and with a high frequency of switching in the direction of the flow of atomizable material, the atomizing gas must be distributed uniformly and with minimal turbulence around the flow of atomizable material. The following examples are presented to illustrate this point. The examples are presented for illustrative purposes and are not intended to be limiting.

Figure 4:
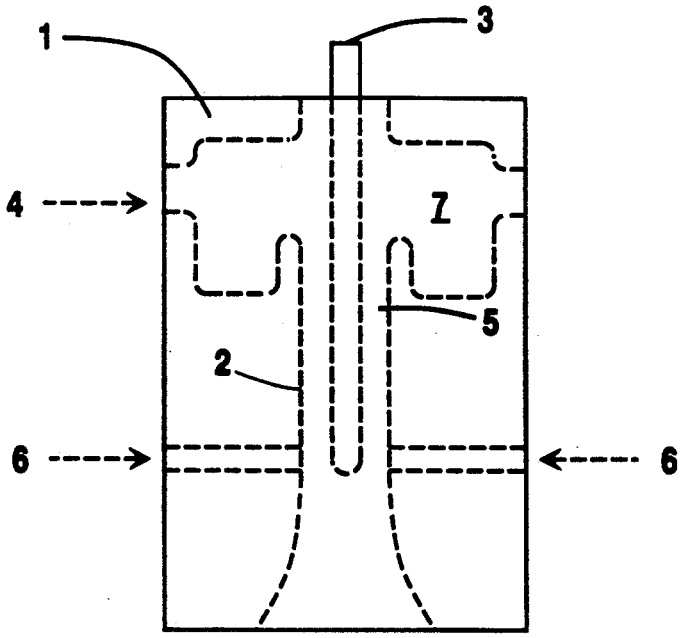
FIG. 4 is a simplified cross-sectional representation of another embodiment of the fluidic atomization system of this invention useful for spray deposition.

Employing an atomizing nozzle similar to that illustrated in FIG. 1, a series of tests were carried out using water as the atomizable material, nitrogen as the atomizing gas and nitrogen as the fluidic control gas. The nozzle was cylindrical having a diameter of three inches and a length of 1.5 inches. The atomizing conduit had a diameter of 0.75 inch in the section of constant diameter and diverged at an angle of 15 degrees for a distance of 0.75 inches and then at an angle of 30 degrees in a conical section of increasing diameter to a final diameter of 1.5 inches. The pouring tube diameter was 0.5 inches, giving a ratio of the diameter of the pouring tube to the diameter of the atomizing conduit, or d/D, of 0.67. The pouring tube was positioned so that its output end was along the centerline of the fluidic control gas ports. A TSX 171-2002 PLC and a 3-position SMC Series NVFS 2000 solenoid valve were used to control the fluidic control gas flow. The solenoid valve was switched so as to direct the spray in a cycle from the first direction to the center to the second direction to the center back to the first direction at 10 hertz. However, it was not possible to effectively obtain a flow of atomized water along the axial center of the nozzle, even when both fluidic control gas ports were closed throughout 80 percent of the cycle time, which should have directed the flow of atomizable material along the axial center during 80 percent of the cycle time. The flow remained in the left or right direction until the opposing fluidic control gas port was opened, resulting in a deposit which was thin in the center and thicker to the left and right. While not wishing to be held to any theory, applicant believes that this failure to switch is caused by residual turbulent eddies in the atomized flow which stabilize the deflection and do not dampen out in the very short time allowed during high frequency switching. For comparison, the nozzle shown in FIG. 4 was used under similar conditions. The nozzle in FIG. 4 is identical to that in FIG. 1, except that the nozzle in FIG. 4 contains an additional element, a plenum chamber 7 communicating with annulus 5, to distribute the atomizing gas with less turbulence and more uniformity around the annular space. The other numerals in FIG. 4 correspond to those of FIG. 1 for the common elements. With the plenum chamber nozzle, it was possible to obtain a uniform deposit over a 13 inch width with the flow directed along the axial center for about 20 percent of the cycle time when the fluidic control gas pressure is about 45 pounds per square inch gauge (psig).

Figure 5:
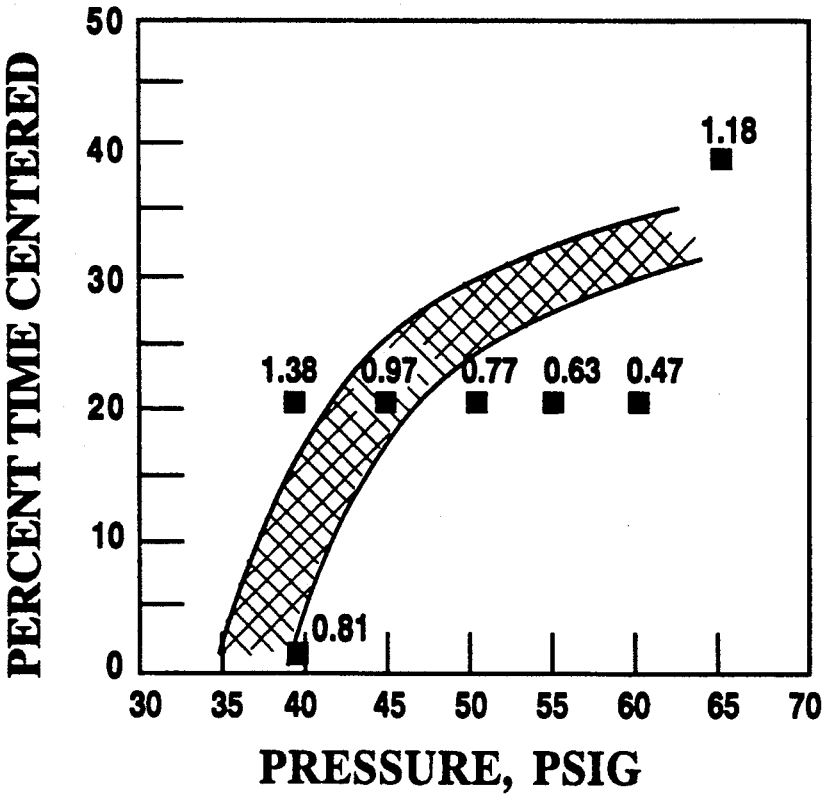
FIG. 5 is a graphical representation of test results obtained with the invention to produce uniform deposit thicknesses.

Different fluidic control gas pressures require slightly different timing of the spray cycle. FIG. 5 shows the results of a series of tests with the nozzle illustrated in FIG. 4 to determine the proper combinations of timing and fluidic gas control pressure. The numbers associated with each point in FIG. 5 represent the ratio of the thickness of the center of the deposit to the maximum thickness at the left or right of center. The numbers are, therefore, a measure of the uniformity of the deposit, with a value of 1 indicating a uniform deposit, values less than one indicating a relatively thin center, and values greater than one indicating a relatively thick center. The shaded area in FIG. 5 represents the desired operating combinations. The vertical axis represents the percentage of time that the atomized flow was centered and the horizontal axis represents the fluidic control gas pressure. At relatively high fluidic control gas pressures, the flow of atomizable material is strongly deflected, and more time is needed directed to the center to achieve a uniform deposit. At lower fluidic control gas pressures, the deflection is weaker, and more time must be spent deflecting the flow to achieve a uniform deposit.

Figure 6:
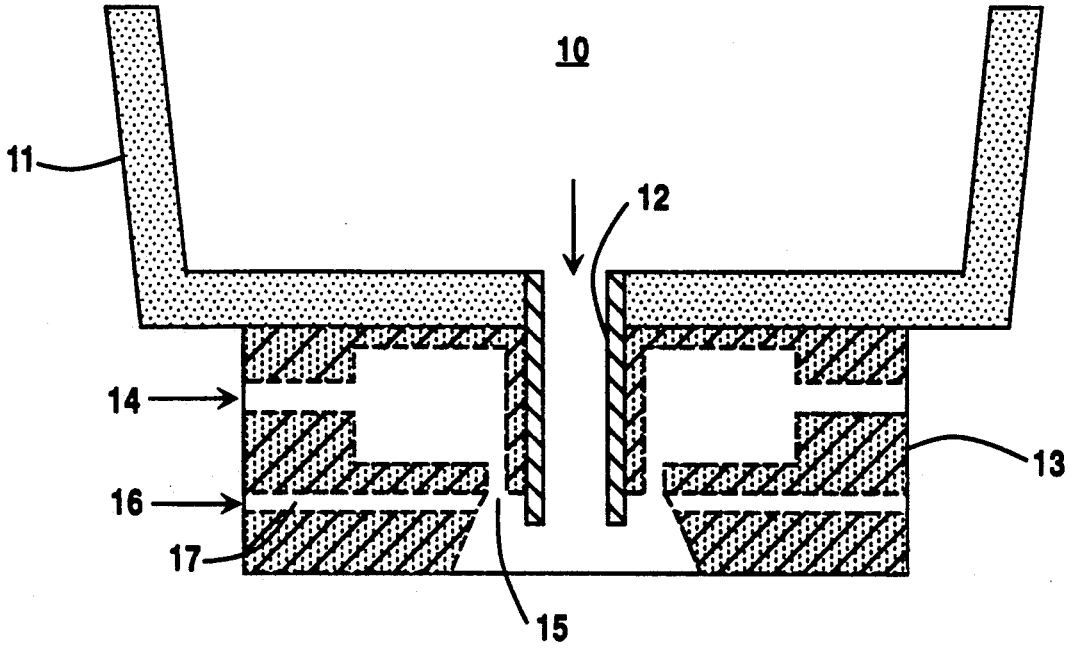
FIG. 6 is a cross-sectional representation of another embodiment of the fluidic atomization system of this invention useful for atomizing molten metal.

FIG. 6 illustrates another embodiment of the invention which is particularly useful when the atomizable material is liquid such as molten metal. Referring now to FIG. 6, atomizable material such as molten metal 10 flows from molten metal crucible 11 into atomizing conduit 12 of atomizing nozzle 13. Atomizing gas 14 is applied to the atomizable material in an annular or coaxial orientation in the section of the atomizing conduit having an increased diameter through annular or coaxial passage 15. Fluidic control gas 16 is applied to the atomizing gas through port 17 in a direction perpendicular to the axial centerline of the atomizing conduit. As a consequence of this contact a pressure differential or gradient is applied across the atomizing gas flow which causes the flow direction of the material atomized by the atomizing gas flow to change direction toward the direction of lower pressure and away from the direction of higher pressure.

Now by the use of the system of this invention, one can achieve flow direction change of atomized material over a wide field without need for mechanical oscillation or movement of the delivery system or even of the injection nozzle. Although the invention has been described in detail with reference to certain embodiments, those skilled in the art will recognize that there are other embodiments of the invention within the spirit and scope of the claims.

I claim:

1. A method for changing the direction of an atomized flow comprising:

(A) passing atomizable material through an atomizing conduit having a section of constant cross-sectional area and downstream thereof a section of increasing cross-sectional area;

(B) atomizing said atomizable material by applying an atomizing gas flow thereto in an annular orientation to said atomizable material to produce an atomized flow;

(C) contacting the atomizing gas flow with fluidic control gas within the atomizing conduit to create a pressure differential across the atomizing gas flow;

(D) causing the flow direction of the atomized flow to change by application of said pressure differential to the atomized flow as a consequence of the atomization of said atomizable material by the application of the atomizing gas flow thereto;

(E) further confining the flow on the side of the atomizing gas opposite the fluidic control gas within the atomizing conduit to increase the pressure differential across the atomizing gas flow; and (F) causing the flow direction of the atomized flow to further change by application of said increased pressure differential.

2. The method of claim 1 wherein the atomizable material comprises liquid material.

3. The method of claim 1 wherein the atomizable material comprises powdered material.

4. The method of claim 1 wherein the atomizable material comprises molten metal.

5. The method of claim 1 wherein the atomizable material comprises powdered metal.

6. The method of claim 1 wherein the atomizable material comprises ceramic.

7. The method of claim 1 wherein the atomizable material comprises fuel.

8. The method of claim 1 wherein the atomizing gas comprises nitrogen.

9. The method of claim 1 wherein the atomizing gas comprises argon.

10. The method of claim 1 wherein the atomizing gas and the fluidic control gas are the same gas.

11. The method of claim 1 wherein the atomizing gas and the fluidic control gas are different gases.

12. The method of claim 1 wherein the fluidic control gas flow is switched among a plurality of directions to generate an oscillating atomized flow.

13. The method of claim 12 wherein the pressure of the fluidic control gas and the timing of the switching are controlled in concert to produce a uniform spray over a wide angle field.

14. The method of claim 1 wherein the flow direction of the atomized flow is continually changed until it flows along the atomizing conduit wall.

* * * * *